US008981320B2

(12) United States Patent
Patel

(10) Patent No.: US 8,981,320 B2
(45) Date of Patent: Mar. 17, 2015

(54) APPARATUS FOR MAINTAINING DENTAL HYGIENE

(76) Inventor: Anish Patel, Fontana, CA (US)

( * ) Notice: Subject to any disclaimer, the term of this patent is extended or adjusted under 35 U.S.C. 154(b) by 146 days.

(21) Appl. No.: 13/556,157

(22) Filed: Jul. 23, 2012

(65) Prior Publication Data

US 2012/0284940 A1 Nov. 15, 2012

(51) Int. Cl.

| | |
|---|---|
| ***A61L 2/10*** | (2006.01) |
| ***A61L 2/00*** | (2006.01) |
| ***A46B 17/06*** | (2006.01) |
| *A46B 5/00* | (2006.01) |
| *A46B 17/04* | (2006.01) |

(52) U.S. Cl.

CPC ..... *A46B 17/06* (2013.01); *A46B 5/0033* (2013.01); *A46B 17/04* (2013.01); *A46B 2200/1066* (2013.01)

USPC ..... 250/492.1; 422/22

(58) Field of Classification Search

CPC ..... A46B 17/06; A46B 5/0033

USPC ..... 422/22; 312/206; 21/83; 250/492.1

See application file for complete search history.

(56) References Cited

U.S. PATENT DOCUMENTS

| | | | | |
|---|---|---|---|---|
| 2,828,504 | A * | 4/1958 | Nugent | 15/184 |
| 5,126,572 | A * | 6/1992 | Chu | 250/455.11 |
| 7,029,788 | B2 * | 4/2006 | Yu et al. | 429/159 |
| 2001/0045369 | A1 * | 11/2001 | Pearlman et al. | 206/362.2 |
| 2006/0090274 | A1 * | 5/2006 | Kim | 15/22.1 |
| 2009/0322190 | A1 * | 12/2009 | Kitagawa et al. | 312/206 |
| 2011/0126370 | A1 * | 6/2011 | Reuben | 15/167.1 |

FOREIGN PATENT DOCUMENTS

CN 201085236 Y * 7/2008

OTHER PUBLICATIONS

English Translation of Document No. CN 201085236 provided by the European Patent Office: Yongqiang Guo; Animal shpaed toothbrush with extensible brush head; Aug. 2010.*

* cited by examiner

*Primary Examiner* — Kevin Joyner

(74) *Attorney, Agent, or Firm* — LeonardPatel PC

(57) ABSTRACT

An apparatus for maintaining dental hygiene is provided. For example, in one embodiment, the apparatus includes a body. The body includes an elongated member configured to extend outward from the body. The elongated member includes a head including a plurality of bristles. The apparatus also includes a cap configured to kill microbes on a plurality of bristles when attached to the body.

9 Claims, 13 Drawing Sheets

APPARATUS FOR MAINTAINING DENTAL HYGIENE

FIELD

The present invention relates to sanitization and, more particularly, to an ultraviolet apparatus that may kill a majority or all of the microbes on the bristles of a toothbrush.

BACKGROUND

Generally, when a person uses a toothbrush, the person cleans the toothbrush after every use. For example, once the person has completed brushing his or her teeth, the person rinses the toothbrush with water and then places the toothbrush on a countertop or a toothbrush holder in the bathroom. However, there may be microbes, which are microscopic living organisms such as bacteria, fungi, protozoa, or viruses, that are located on the countertop and/or on the toothbrush holder. Furthermore, simply rinsing the bristles of the toothbrush does sanitize the bristles of the toothbrush, and as a result, microbes may end up or remain on the bristles of the toothbrush, thus potentially negatively affecting the hygiene of the person.

Furthermore, when a person travels with a toothbrush, the person may place the toothbrush on the countertop of a hotel room or place the toothbrush in the travel kit, for example. The countertop in a bathroom of the hotel room is known to host microorganisms. Also, a travel kit that is not properly sanitized on a regular basis may host microorganisms. Thus, travel may particularly affect the hygiene of the toothbrush.

Currently, there are devices that attempt to prevent microbes from contacting the bristles. For example, a toothbrush may include a cap that covers the bristles after every use. However, the use of a cap does not effectively prevent microbes from contacting the bristles of the toothbrush. Without sanitizing the bristles of the toothbrush using proper measures, microbes cannot be effectively destroyed. Also, repeated use of the cap without proper sanitization causes the bristles to carry microbes. Thus, it may be beneficial to employ a more effective sanitization mechanism that reduces or eliminates microbes from a toothbrush, and in particular, the bristles of the toothbrush.

SUMMARY

Certain embodiments of the present invention may provide solutions to the problems and needs in the art that have not yet been fully identified, appreciated, or solved by current bristle cleaning mechanisms. For example, one or more embodiments of the present invention pertain to an apparatus that includes an ultraviolet light configured to eliminate bacteria from the bristles of a toothbrush.

In one embodiment, an apparatus may include a body. The body includes an elongated member configured to extend outwards from the body. The elongated member includes a head including a plurality of bristles. The apparatus also includes a cap configured to kill microbes on a plurality of bristles when attached to the body.

In another embodiment, an apparatus may include at least one light attached to an interior of the apparatus and configured to kill microbes on a plurality of bristles.

In yet another embodiment, an apparatus may include an elongated member housed within a body of the apparatus. The elongated member may include a head enclosed within an enclosure to mitigate against microbes coming in contact with the head.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

One or more embodiments of the present invention pertain to an apparatus, and in particular, a toothbrush, that encourages children, as well as adults, to use the apparatus to brush their teeth and maintain healthier teeth. In one embodiment, the apparatus may be utilized for travel purposes, or for home use. For example, the apparatus may be configured to clean the bristles of the toothbrush regardless of the environment in which the toothbrush is used.

The apparatus may include a body and a cover to cover the bristles. To access the bristles, a release button may be pressed to push, or extend, the brush head out of the body. The cap may be removed and brushing can be performed. Once the person has finished brushing his or her teeth, the person may push the brush head inside the body, and attach the cap on the bristles to cover and protect the bristles from getting damaged or affected by microbes. In certain embodiments, an ultraviolet light may be included inside the cap to eliminate a majority or all the germs on the bristles, thereby making the apparatus ideal for travel purposes.

Figure 1:
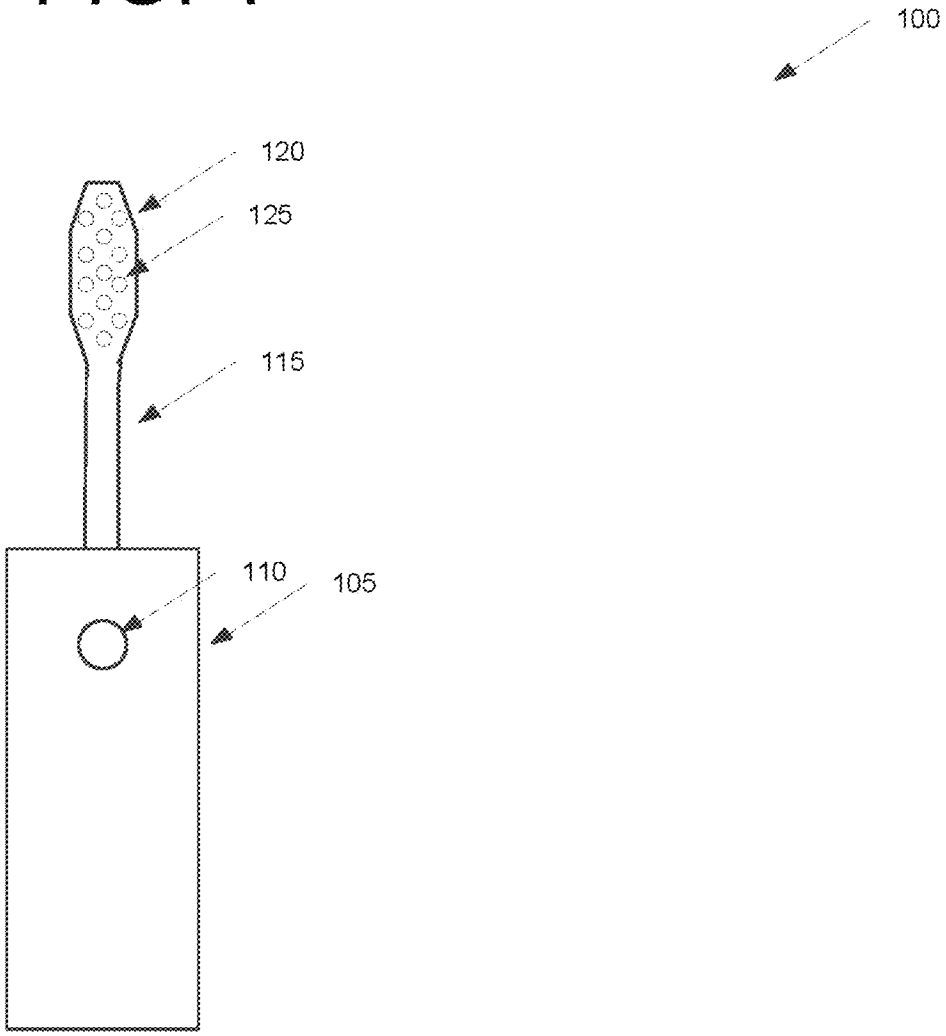
FIG. 1 illustrates a toothbrush with bristles, according to an embodiment of the present invention.

FIG. 1 illustrates a toothbrush 100 with bristles 125, according to an embodiment of the present invention. In this embodiment, toothbrush 100 includes a body 105 having a release button 110. When release button 110 is pressed by the user, an elongated member 115 is extended from body 105. This functionality may be implemented using a latch and spring system, a servo, or by any other system that would be understood by one of ordinary skill in the art. Elongated member 115 includes a head 120. Head 120 includes a plurality of bristles 125.

Figure 2:
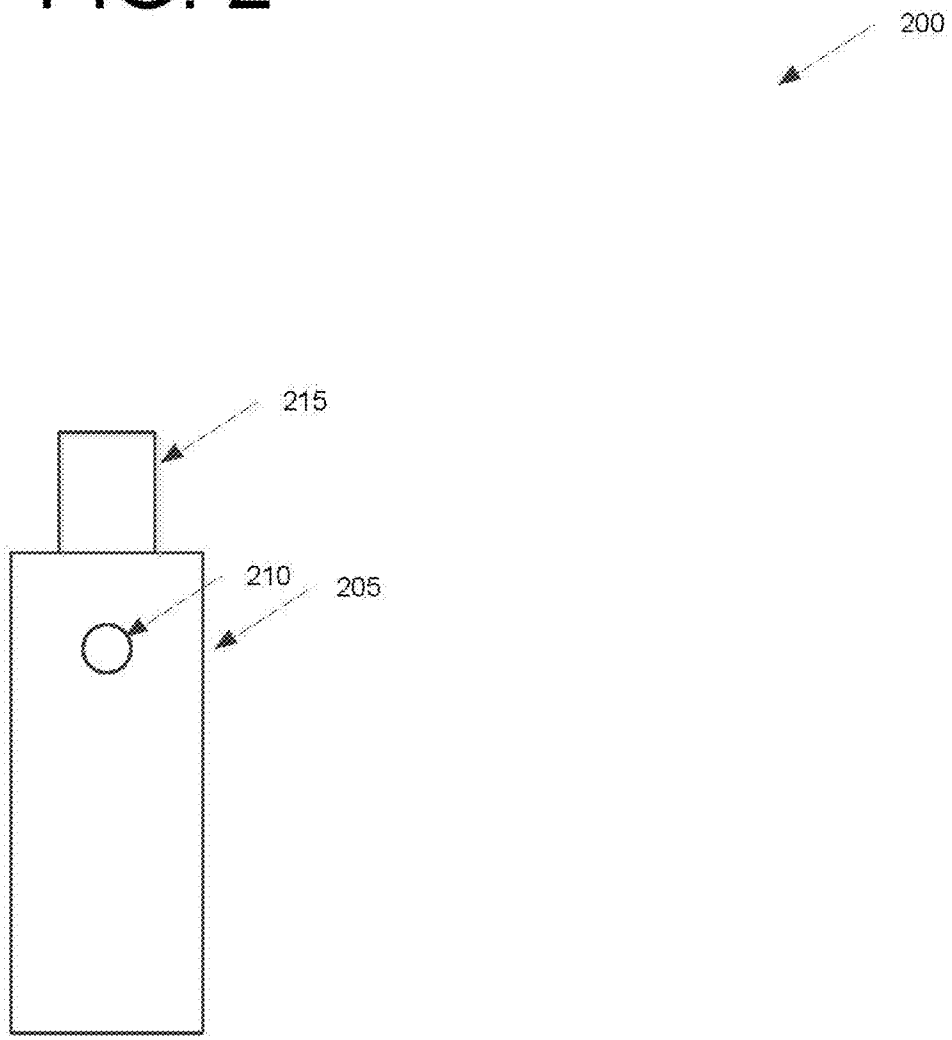
FIG. 2 illustrates a toothbrush with a cap, according to an embodiment of the present invention.

FIG. 2 illustrates a toothbrush 200 with a cap 225, according to an embodiment of the present invention. Toothbrush 200 includes a body 205 having a release button 210, such that an elongated member located inside body 205 can extend out of body 205 when pressed by the user. In this embodiment, the elongated member (not shown) is contained within body 205 with the bristles (also not shown) of the elongated member contained within a cover 215. Cover 215 may be used to protect the bristles from acquiring microbes when toothbrush 200 is not in use.

Figure 3:
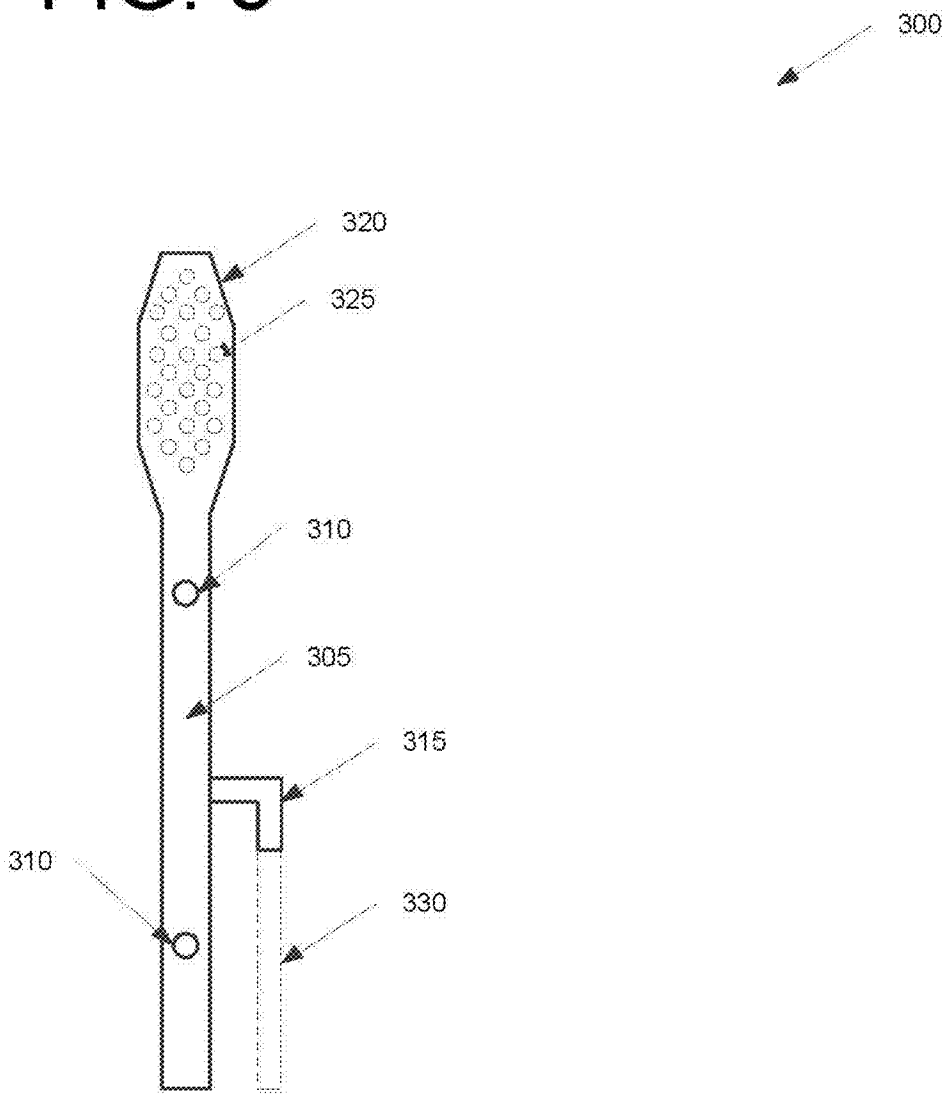
FIG. 3 illustrates an elongated member, according to an embodiment of the present invention.

FIG. 3 illustrates an elongated member 300, according to an embodiment of the present invention. Elongated member 300 includes an elongated structure 305 including at least two connecting elements (or structures) 310. Connecting elements 310 are configured to maintain a position of elongated member 300 when elongated member is contained within a body of a toothbrush or when extended outward from the body of the toothbrush.

Figure 4:
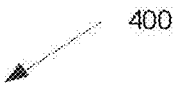
FIG. 4 illustrates a spring, according to an embodiment of the present invention.
Figure 4:
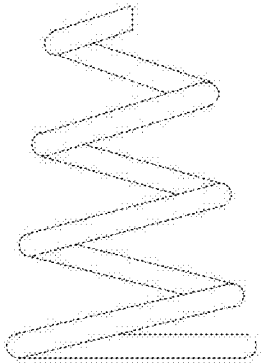

Elongated structure 305 also includes a spring holding mechanism 315. Spring holding mechanism 315 may be operably attached or otherwise connected to a spring 330. Spring 330 is configured to extend elongated member 300 from the body of the toothbrush when a release button, such as release button 110 of FIG. 1, is pressed by the user. As shown in FIG. 4, spring 400 may be a conical spring. The spring may also be a helical spring, or any suitable type of spring that would be appreciated by a person of ordinary skill in the art.

Elongated member 300 also includes a head 320 with a plurality of bristles 325. Bristles 325 are configured to clean the teeth of a user when applied against the teeth of the user in any desired motion. As discussed above, a cover may be used to cover head 320 and bristles 325 when the toothbrush is not in use.

Figure 5A:
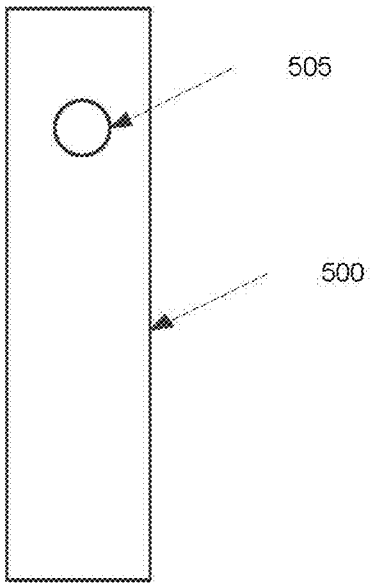
FIG. 5A illustrates an external view of a first member of the body, according to an embodiment of the present invention.
Figure 5B:
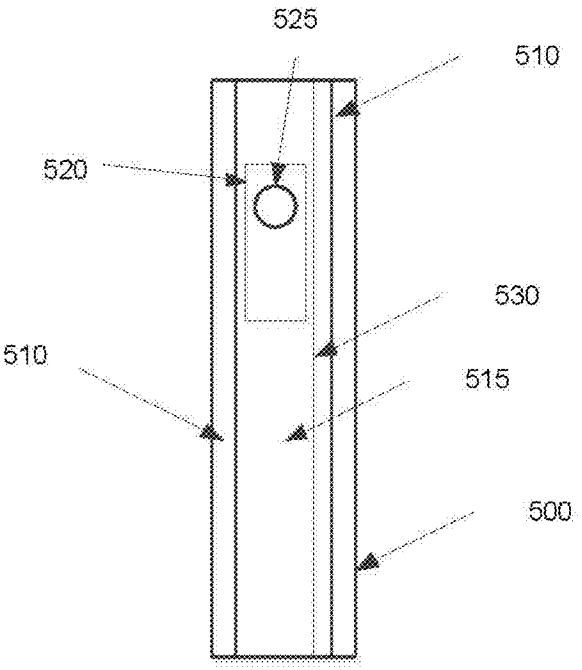
FIG. 5B illustrates an internal view of the first member of the body, according to an embodiment of the present invention.
Figure 5C:
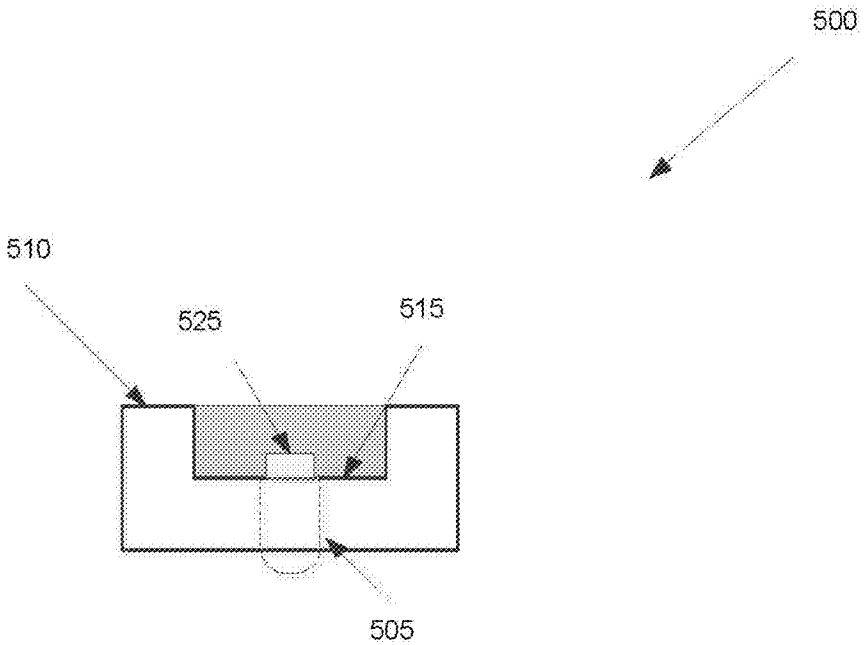
FIG. 5C illustrates a cross-sectional view of the first member of the body, according to an embodiment of the present invention.
Figure 6A:
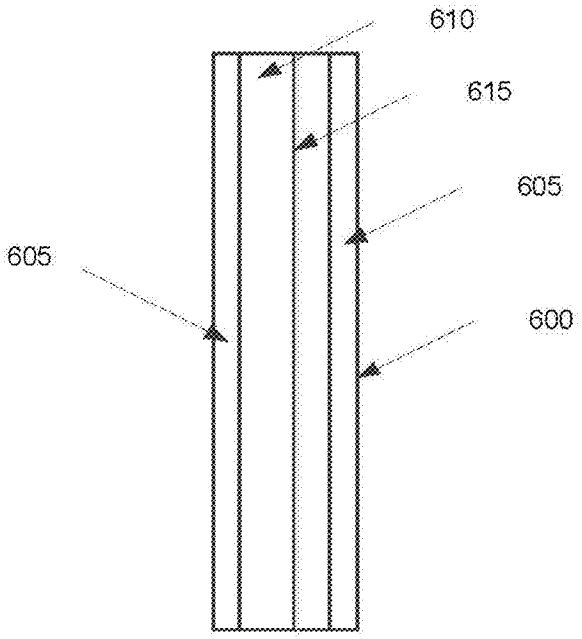
FIG. 6A illustrates an internal view of a second member of the body, according to an embodiment of the present invention.
Figure 6B:
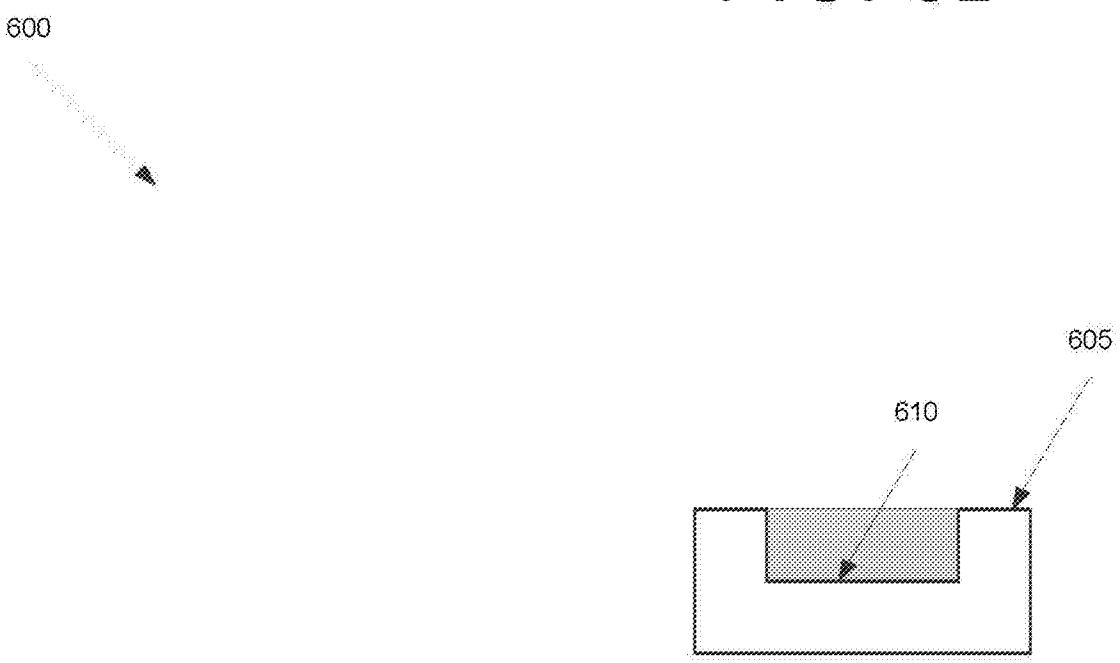
FIG. 6B illustrates a cross sectional view of the second member of the body, according to an embodiment of the present invention.

It should be appreciated that the body of the toothbrush includes at least two members in this embodiment. FIGS. 5A-C illustrate a first member 500, and FIGS. 6A and 6B illustrate a second member 600, according to an embodiment of the present invention. FIG. 5A, for example, illustrates an external view of first member 500. First member 500 may include an opening 505 that allows a release button to be inserted through opening 505. Opening 505 may be a circular opening, a rectangular opening, or may be any shape that would be appreciated by a person of ordinary skill in the art. As discussed above, the release button is configured to allow the elongated member to extend outward when the user presses the release button.

FIG. 5B illustrates an internal view of first member 500, according to an embodiment of the present invention. The internal view of first member 500 shows a recess 515 that allows an elongated member to move up and down in a vertical direction. Recess 515 may be formed by guiding members 510. Guiding members 510 may prevent the elongated member from moving in a horizontal direction. A guide rail 530 is included in this embodiment to also allow the elongated member to move in a vertical direction rather than a horizontal direction.

First member 500 may also include a release mechanism 520. Release mechanism 520 may be located in recess 515, such that a release button 520 may extend through opening 505. Release mechanism 520 may be operably connected to first member 500 via a connecting member (not shown). Moreover, a spring (not shown) may be situated between release mechanism 520 and first member 500, such that when release button 525 is pressed by the user, the elongated member may be released from the body of the toothbrush.

FIG. 5C illustrates a cross-sectional view of first member 500, according to an embodiment of the present invention. In the cross-sectional view, release button 525 extending through hole 505 is shown. Also, guiding members 510 form a recess 515.

As mentioned above, FIG. 6A illustrates an internal view of a second member 600 of the body, according to an embodiment of the present invention. In this embodiment, second member 600 includes guiding members 605 that form a recess 610. See also FIG. 6B. As discussed above, the elongated member is placed within a recess formed by the first member and the second member of the toothbrush (namely, recesses 515 and 610), such that the elongated member can move in a vertical direction. Similar to the guiding members shown in FIG. 5B, guiding members 605 of second member 600 prevent the elongated member from moving in a horizontal direction. To further prevent movement in a horizontal direction, second member 600 also includes a guide rail 615 configured to guide the elongated member in a vertical direction.

Figure 7:
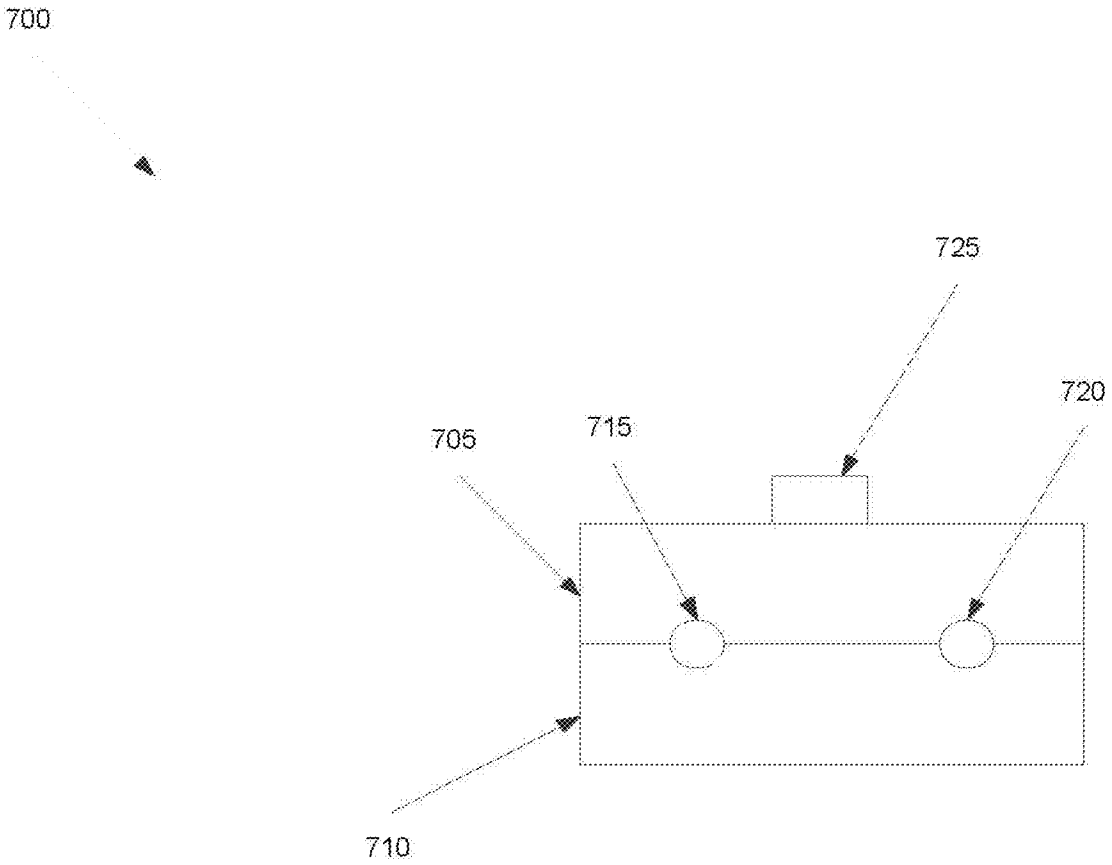
FIG. 7 illustrates a base of the body, according to an embodiment of the present invention.

FIG. 7 illustrates a base 700 of the body, according to an embodiment of the present invention. Base 700 illustrates a first member 705 and a second member 710. When first member 705 and second member 710 are connected, a first hole 715 and a second hole 720 are formed. First hole 715 and second hole 720 are configured to drain water or other liquids from the body. For example, when a user brushes his or her teeth, liquid, such as water and/or toothpaste, may be captured within the toothbrush. The liquid may slowly corrode internal components, such as the spring of the toothbrush. To prevent this type of corrosion, first hole 715 and second hole 720 are configured to release the captured water from the body of the toothbrush. This may increase the longevity of the toothbrush.

Figure 8A:
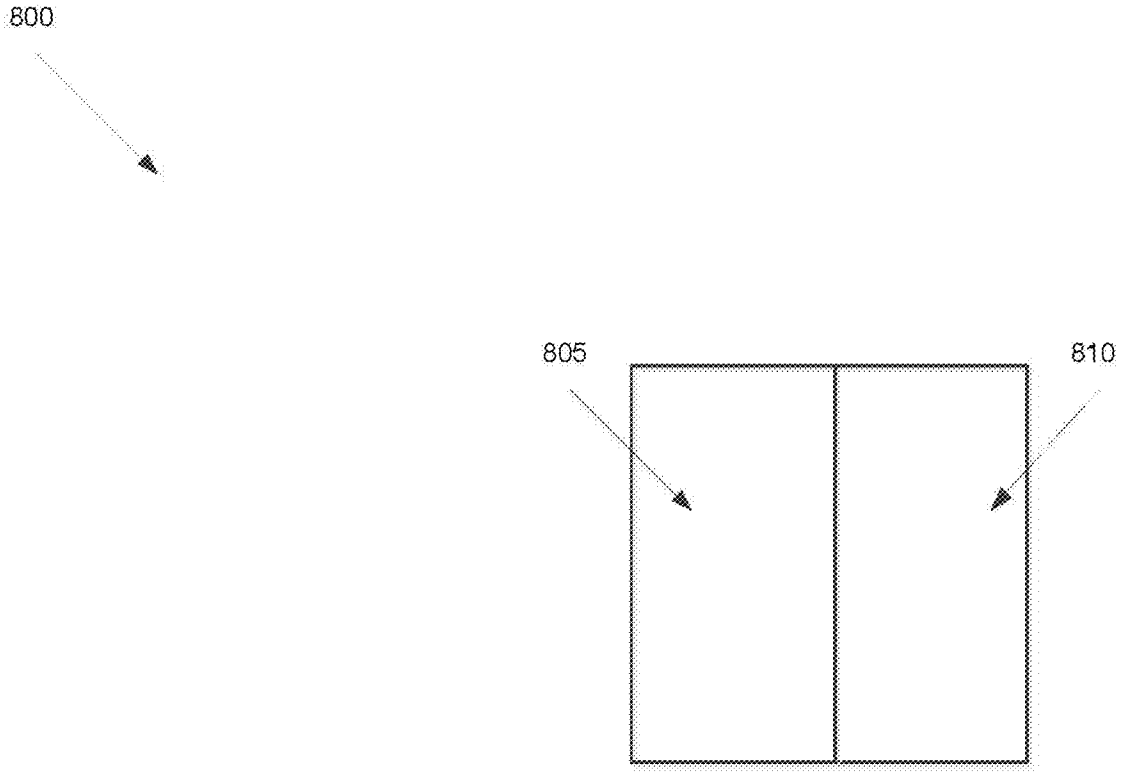
FIGS. 8A and 8B illustrate a first and second view of a cap, according to an embodiment of the present invention.

FIG. 8A illustrates first view of a cap 800, according to an embodiment of the present invention. Cap 800 may include a first member 805 and a second member 810. First member 805 and second member 810, when adjoined, are configured to provide an enclosure around the head, including the bristles, of the toothbrush. This may allow the bristles to be stored within cap 800 and prevent microbes from contacting the bristles of the toothbrush when a user places the toothbrush on a bathroom countertop, sink, etc.

Figure 8B:
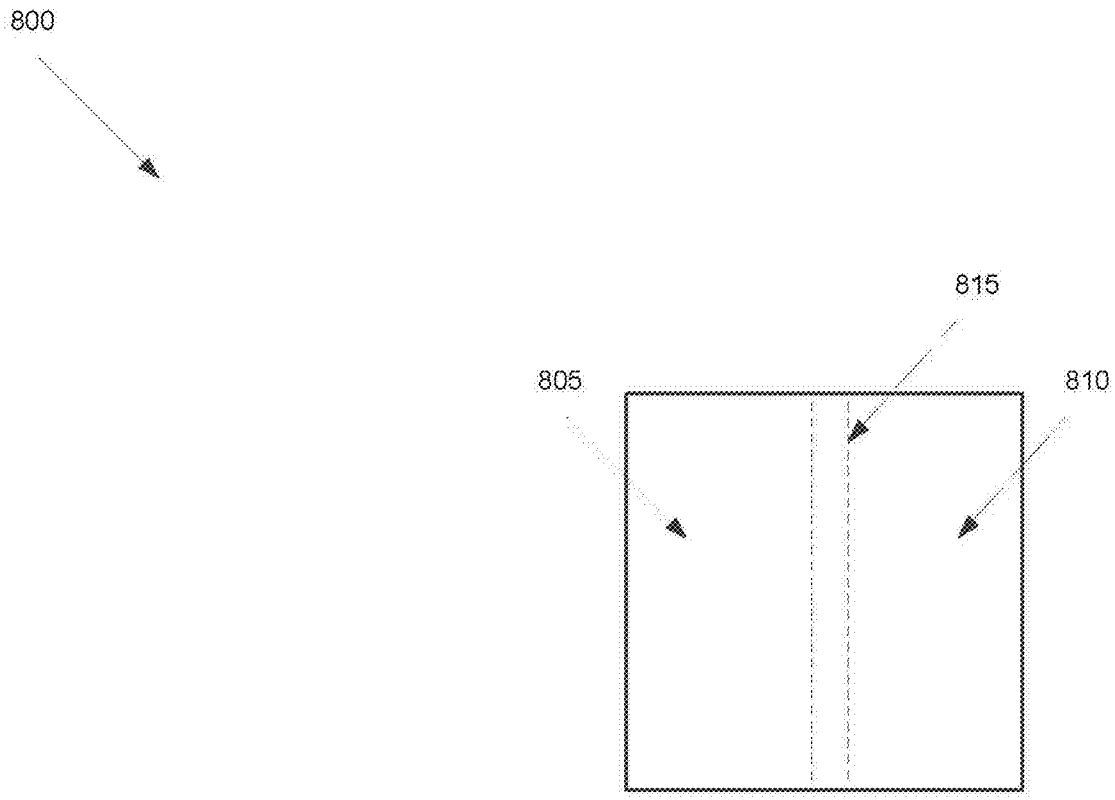

It should be appreciated that cap 800 may be closed, and remain closed, by locking mechanisms (not shown). For example, first member 805 and second member 810 may be adjoined by a snap, a latch, or any other suitable mechanism. In order to open and close cap 800, a hinge 815 may be used. See FIG. 8B. This may allow first member 805 and second member 810 to open and close in a horizontal direction.

Figure 9:
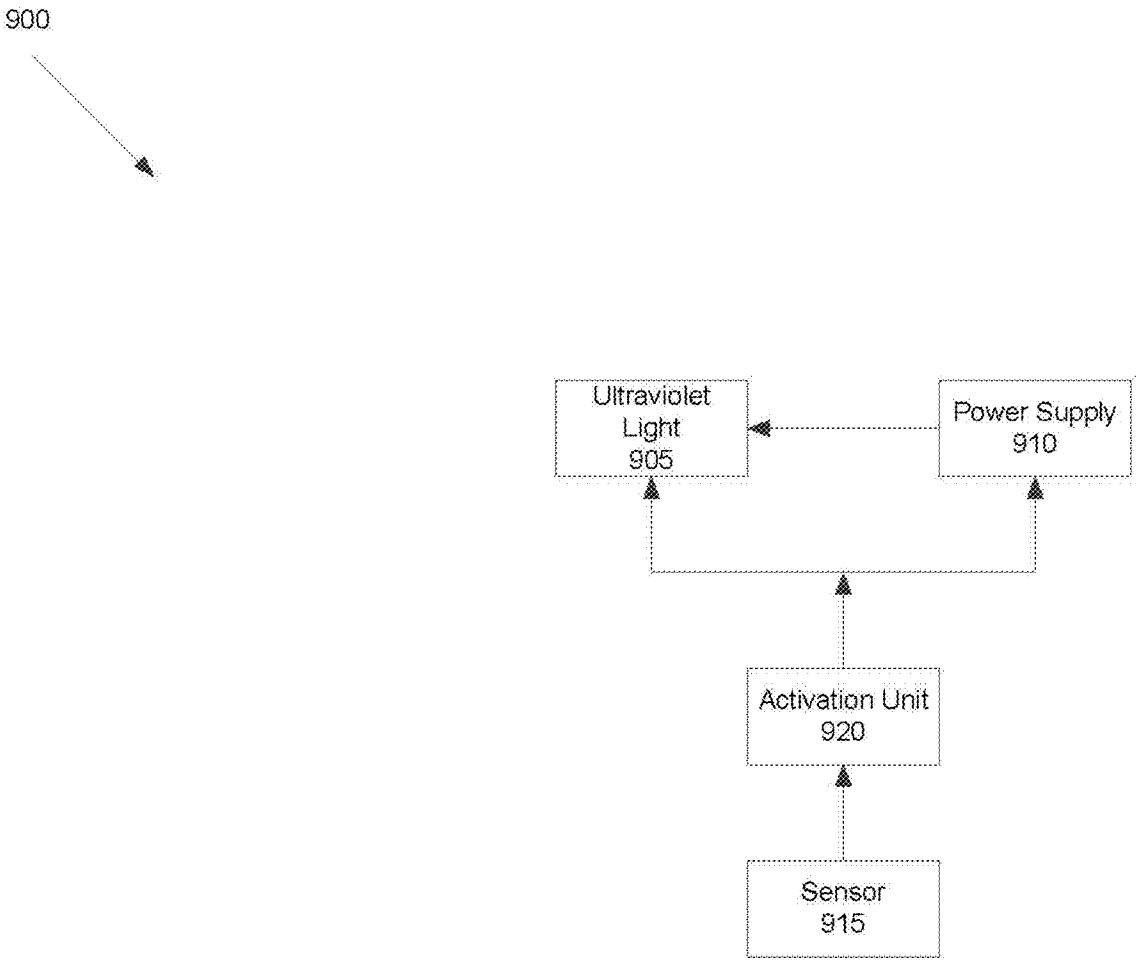
FIG. 9 illustrates a cap, according to an embodiment of the present invention.

FIG. 9 illustrates a cap 900, according to an embodiment of the present invention. In this embodiment, cap 900 may include an ultraviolet light 905 configured to kill microbes from the bristles of the toothbrush. In some embodiment, a plurality of ultraviolet lights may be utilized depending on the configuration of the cap, bristles, etc. A person of ordinary skill in the art will appreciate other types of lights, other than ultraviolet lights, may be used to kill microbes on the bristles of the toothbrush.

A power supply 910 may provide power to ultraviolet light 905. Power supply 910 may include button batteries, AA batteries, AAA batteries, rechargeable batteries, or any type of battery that would be appreciated by a person of ordinary skill in the art. Power supply 910 may be a removable power supply, such that the power supply may be swapped when power is lost. Power supply 910 may also be configured to be plugged into a power outlet, providing direct power, power to charge the battery, etc. In certain embodiments, no battery may be used and outlet power alone may power the components of the toothbrush.

Cap 915 may also include a sensor 915 configured to detect whether cap 900 is opened or closed. In certain embodiments, sensor 915 may also detect whether bristles are contained within cap 900. If sensor 915 detects that cap 900 is closed and/or bristles are contained within cap 900, then an activation unit 920 may be configured to activate ultraviolet light 905 to kill microbes on the bristles of the toothbrush.

Activation unit 920 may activate ultraviolet light 905 for a predetermined or predefined period of time, e.g., 30 seconds, 1 minute, etc. After the predetermined period of time has elapsed, activation unit 920 may deactivate ultraviolet light 905 to conserve the energy stored within power supply 905. It should also be appreciated that the period of time for activating ultraviolet light 905 may be changed depending on the configuration of the bristles and/or the desires of the user.

One or more embodiments pertain to a toothbrush that utilizes ultraviolet light(s) to kill microbes on bristles of the toothbrush. For example, when the bristles of the toothbrush are inserted into a cap of the toothbrush, an ultraviolet light is activated for a predetermined period of time to kill microbes on the bristles of the toothbrush.

It will be readily understood that the components of the invention, as generally described and illustrated in the figures herein, may be arranged and designed in a wide variety of different configurations. Thus, the following detailed description of the embodiments is not intended to limit the scope of the invention as claimed, but is merely representative of selected embodiments of the invention.

The features, structures, or characteristics of the invention described throughout this specification may be combined in any suitable manner in one or more embodiments. For example, the usage of "certain embodiments," "some embodiments," or other similar language, throughout this specification refers to the fact that a particular feature, structure, or characteristic described in connection with an embodiment may be included in at least one embodiment of the invention. Thus, appearances of the phrases "in certain embodiments," "in some embodiments," "in other embodiments," or other similar language, throughout this specification do not necessarily all refer to the same embodiment or group of embodiments, and the described features, structures, or characteristics may be combined in any suitable manner in one or more embodiments.

One having ordinary skill in the art will readily understand that the invention as discussed above may be practiced with steps in a different order, and/or with hardware elements in configurations that are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. An apparatus, comprising:

a body comprising an elongated member configured to extend outwards from the body of a toothbrush when a release button is pressed, the elongated member comprising a head comprising a plurality of bristles;

a cap comprising a hinge configured to open and close the cap in a horizontal direction, and kill microbes on a plurality of bristles when attached to the body of the toothbrush; and a sensor configured to detect whether the cap containing the bristles is in a closed state, the sensor is further configured to notify an activation unit to activate at least one ultraviolet light when the sensor determines the cap comprising the hinge is closed, wherein the activation unit is configured to deactivate the at least one ultraviolet light after a predefined period of time to conserve energy stored within a power supply, and the elongated member comprises a first connecting element and a second connecting element, the first connecting element in contact with the release button when the elongated member is in a first position, and the second connecting element in contact with the release button when the elongated member is in a second position that extends the elongated member outward from the body of the toothbrush, and the release button is further configured to cause a spring housed within the body of the toothbrush to automatically extend the elongated member from the body of the toothbrush when the release button is pressed.

2. The apparatus of claim 1, wherein the cap further comprises the at least one ultraviolet light configured to kill the microbes on the plurality of bristles.

3. The apparatus of claim 2, wherein the at least one ultraviolet light is further configured to illuminate for the predefined period of time.

4. The apparatus of claim 2, wherein the power supply configured to provide power to the at least one ultraviolet light.

5. The apparatus of claim 4, wherein the power supply comprises a rechargeable power supply.

6. The apparatus of claim 4, wherein the power supply comprises a replaceable power supply.

7. The apparatus of claim 1, wherein the sensor is further configured to detect whether the cap is attached to the elongated member of the body.

8. The apparatus of claim 1, wherein the sensor is further configured to detect whether the cap surrounds a plurality of bristles.

9. The apparatus of claim 1, wherein the activation unit configured to activate the at least one ultraviolet light for the predefined period of time.

* * * * *